US006993878B2

(12) United States Patent
Prokofyev

(10) Patent No.: US 6,993,878 B2
(45) Date of Patent: Feb. 7, 2006

(54) UNIVERSAL MODULAR BUILDING BLOCK

(75) Inventor: Yuriy Prokofyev, San Francisco, CA (US)

(73) Assignee: Leo Ostrovsky, San Francisco, CA (US)

( * ) Notice: Subject to any disclaimer, the term of this patent is extended or adjusted under 35 U.S.C. 154(b) by 15 days.

(21) Appl. No.: 10/779,349

(22) Filed: Feb. 14, 2004

(65) Prior Publication Data

US 2004/0159068 A1 Aug. 19, 2004

Related U.S. Application Data

(62) Division of application No. 10/345,462, filed on Jan. 17, 2003, now Pat. No. 6,691,485.

(51) Int. Cl.
*E04B 5/04* (2006.01)

(52) U.S. Cl. ..... 52/604; 52/607; 52/606; 52/565; 52/405.1; 52/405.2

(58) Field of Classification Search ..... 52/604, 52/565, 606, 605, 607, 405.1, 405.2
See application file for complete search history.

(56) References Cited

U.S. PATENT DOCUMENTS 2,703,487 A * 3/1955 Ossoinack ..... 52/592.3
3,885,363 A * 5/1975 Whittey ..... 52/125.3
4,002,002 A * 1/1977 Barnhardt, Jr. ..... 264/46.6
4,016,693 A * 4/1977 Warren ..... 52/405.1
4,091,590 A * 5/1978 Miura ..... 52/591.5
4,223,501 A 9/1980 DeLozier
4,590,729 A * 5/1986 Hegazi ..... 52/437
5,349,798 A * 9/1994 Gross ..... 52/405.1
5,596,855 A 1/1997 Batch
6,018,922 A * 2/2000 McKinnon ..... 52/700
6,082,067 A * 7/2000 Bott ..... 52/592.3
D429,346 S * 8/2000 Martin, Jr. ..... 52/604
6,122,881 A * 9/2000 Aubertot ..... 52/604
6,226,951 B1 * 5/2001 Azar ..... 52/604
6,253,523 B1 * 7/2001 McKinnon ..... 52/700
6,691,485 B1 * 2/2004 Prokofyev ..... 52/604

* cited by examiner

*Primary Examiner*—Brian E. Glessner
*Assistant Examiner*—Nahid Amiri

(57) ABSTRACT

The invention relates to modular building blocks with the minimal possible number of types which can be used for construction of buildings or other structures. The block has cellular structure defined by through openings made in the block body. The number of cells depends on the number of through holes. Each block has an upper and inner insert made of a heat/cold-insulation material and inserted into through openings of the hollow block. The inserts, in turn, have through holes and recesses arranged so that after the blocks with inserts are assembled into a building or a structure, the openings and the recesses in the inserts form a continuous lattice-like space suitable for pouring concrete or another hardenable material which after curing form a load-carrying lattice-like framework of the building or the structure. Thus, the inserts are used as formwork-elements for pouring the concrete. Since the inserts are made of a soft heat/cold insulating material, they compensate for lateral forces developed during setting of the concrete and thus unload the inner and outer walls of the structure. The invention also relates to the method of construction and to structural elements and buildings erected by the aforementioned method from the blocks of the invention.

11 Claims, 12 Drawing Sheets

UNIVERSAL MODULAR BUILDING BLOCK

CROSS-REFERENCE TO RELATED APPLICATION

The present patent Application is divisional of U.S. patent application Ser. No. 10/345,462 filed on Jan. 17, 2003 and issued on Feb. 17, 2004 as U.S. Pat. No. 6,691,485.

FIELD OF THE INVENTION

The present invention relates to the field of construction, in particular to a modular building block, as well as to a method of construction of buildings and other structures on the basis of the aforementioned block. The invention also relates to the construction of structural elements and buildings erected with the use of the aforementioned universal building blocks by the aforementioned method.

BACKGROUND OF THE INVENTION

A hollow modular building block made of concrete has being known and used in the American construction industry since the beginning of the $20^{th}$ century. This technology is still extensively used till the present time, and a great variety of standardized hollow modular building blocks are available on the market. See, e.g., U.S. Pat. No. 6,088,987 issued in 2000 to Simmons, et al., U.S. Pat. No. 5,822,922 issued in 1998 to Haener, etc. An example of a typical known hollow modular concrete block is shown in FIG. 1. It can be seen from this drawing that the block 20 comprises a molded concrete body 22 with two through openings 24, 26 with a separating wall 28 between the openings. For technological purposes the openings may have tapered surfaces. FIG. 2 is a three-dimensional view of a part of a wall 30 assembled from the hollow modular building blocks 32, 33, 34, 35 of the type shown in FIG. 1. The blocks are bonded to each other by seams 36, 37, 38, 39, 40, 41, and 42 of a binding material such as mortar.

The main disadvantage of the existing hollow modular building block shown in FIGS. 1 and 2 is that in a construction element assembled from such blocks the load-carrying function is fulfilled by the blocks themselves. Therefore they have to be made of a sufficiently strong and durable material which always be maintained under loading conditions. For the above reason, the existing blocks of the aforementioned type are produced from special grades of concrete, which makes the structural element heavy in weight and expensive to manufacture.

In order to solve the problem of strength and durability, the hollows 44, 46, 48, 50 (FIG. 2) can be filled with a mortar. FIG. 3 illustrates a cross section of a part of a construction element 52 assembled from the hollow modular blocks 54 and 56 filled with concrete 53. Such a construction becomes much heavier and more expensive than the one shown in FIG. 2, since it consumes more material.

Another disadvantage of both structures shown in FIGS. 2 and 3 is a provision of so called "bridges of cold" which impart to the blocks as well as to the construction elements assembled from the blocks heat- and cold-conductive properties. More specifically, partitions 45 and 49 between the openings 44, 46 and 48, 50, respectively, as well as a partition 51 between the blocks 32 and 34 interconnect the outer and inner surfaces of the blocks and construction elements. This means that the wall made of the hollow modular blocks of the type shown in FIG. 1 will conduct heat/cold between the inner and outer surfaces. In the construction shown in FIG. 3, the heat/cold conducting problems become even more aggravated since the "bridge of cold" is distributed over the entire cross-section of each block. Therefore, additional heat-insulating elements, such as thermoinsulating layers, must be incorporated into the construction of structural elements, if heat-insulating properties are critical.

Still another disadvantage of the existing modular hollow concrete block is that the load-carrying function of a load-carrying element cannot be easily combined with architectural functions such as texture, color, hiding of connection seams, decorative properties of the internal and external surfaces, etc. Therefore, for acquiring the aforementioned additional properties, the surfaces of the construction elements, such as walls, assembled from the existing modular hollow blocks must be coated with additional facing or decorative panels.

It is also known to build insulated concrete wall structures by using a plurality of modules stacked together to provide a concrete form which can subsequently be filled with cementation material and thereby provide a unitary concrete wall structure. U.S. Pat. No. 4,223,501 issued to DeLozier in 1980 teaches the use of such a module for the fabrication of a concrete monolithic wall structure having foam insulation permanently attached to the structure and forming the inner and outer wall surfaces. The main advantages of this method of building is that the concrete forms remain in place as a useful component of the wall structure.

When a plurality of the prior art modules are assembled into a concrete building form, the sides of the module often are of inadequate strength to provide the necessary support required to contain the wet cement until it can "set" and thereby become a self supporting monolithic concrete wall of an enclosure. Lateral movement of the module walls results in an unsightly and unacceptable wall surface, accordingly, it is absolutely necessary that something be done to increase the wall strength to where there is no doubt that the module walls will resist lateral movement occasioned by the hydrostatic head of the wet concrete. Consequently, it is common practice to augment the strength of the module by employing extraneous timbers assembled into a lattice work and tied against the module walls to help contain the wet cement until it can "set".

For this and other reasons, many skilled in the art prefer the old technique of building concrete forms made of 2×4 timbers and plywood tied together in a manner to provide a structure that adequately resists the hydrostatic pressure of the concrete, rather than utilize the more modem and cost effective foam plastic module.

An attempt has been made to solve the problem of the concrete form described in U.S. Pat. No. 4,223,501. For example, U.S. Pat. No. 5,596,855 issued to Batch in 1997 provides improvements in foam plastic modules for use in building construction that overcomes the above disadvantages of lateral movement of the module walls and eliminates the need for the extraneous timbers. This is achieved by the provision of a special tension member imbedded within the foam plastic in a manner that secures the opposed wall structure together and thereby resists lateral movement thereof. After the wet concrete has set, the tension members provide a support for subsequent attachment of paneling and other decorative material that may be employed on the inner and outer wall surfaces of the structure.

A disadvantage of the structure of U.S. Pat. No. 5,596,855 consists in that it consumes a significant amount of material, such as cement, for the formation of a load-carrying part of the structural element or building. This is because the aforementioned load-carrying part comprises a monolithic molded body. Another disadvantage of the construction of U.S. Pat. No. 5,596,855 is that it requires the use of spaced tension members inside the interior cavity of the form for connecting the inner and outer walls of the structure as a means for resisting lateral deformations of the walls during the concrete setting period. In other words, during setting of the concrete that forms a monolithic load-carrying structure inside the wall, the inner and outer foam plastic panels are subjected to the action of lateral forces

OBJECTS AND SUMMARY OF THE INVENTION

It is an object of the present invention to provide a hollow modular building block, which reduces amount of material required for the formation of a load-carrying structure of the construction element or a framework of the building and works under no-load or low-load conditions and therefore can be made of wood, plastics, and lightweight concrete, such as a fiber-reinforced concrete, and different composite materials. Another object is to provide a hollow modular building block which is free of bridges of cold and possess excellent heat/cold insulating properties. Another object is to provide a modular building block in which the function of a formwork for molding the load-carrying structure is fulfilled by a heat/cold insulating insert of the block. Still another object is to provide a hollow modular building block in which the heat/cold insulating insert combines the function of formwork with the function of a load-releasing component that compensates for lateral forces developed during setting of the concrete load-carrying structure. Still another object is to provide a building block which, after being assembled into the wall or another structural element makes it possible by pouring cement into the interior of the assembled structure to form a lattice-like load-carrying framework with all the advantages of the lattice structure as compared to a monolithic structure. Another object is to provide a quick, inexpensive, and efficient method of construction of structural elements and buildings with a lattice-like load-carrying structure on the basis of the aforementioned hollow modular block. Another object is to provide a novel structural element or a building assembled from the aforementioned hollow modular building blocks by the aforementioned method.

The invention relates to modular building blocks with the minimal possible number of types which can be used for construction of buildings or other structures. The block has cellular structure defined by through openings made in the block body. The number of cells depends on the number of through holes. Each block has an upper and inner insert made of a heat/cold-insulation material and inserted into through recesses of the hollow block. The inserts, in turn, have through holes and recesses arranged so that after the blocks with inserts are assembled into a building or a structure, the openings and the recesses in the inserts form a continuous lattice-like space suitable for pouring concrete or another hardenable material which after curing form a load-carrying lattice-like framework of the building or the structure. Thus, the inserts are used as formwork elements for pouring the concrete. Since the inserts are made of a soft heat/cold insulating material, they compensate for lateral forces developed during setting of the concrete and thus unload the inner and outer walls of the structure. The invention also relates to the method of construction and to structural elements and buildings erected by the aforementioned method from the blocks of the invention.

DETAILED DESCRIPTION OF THE INVENTION

Figure 1:
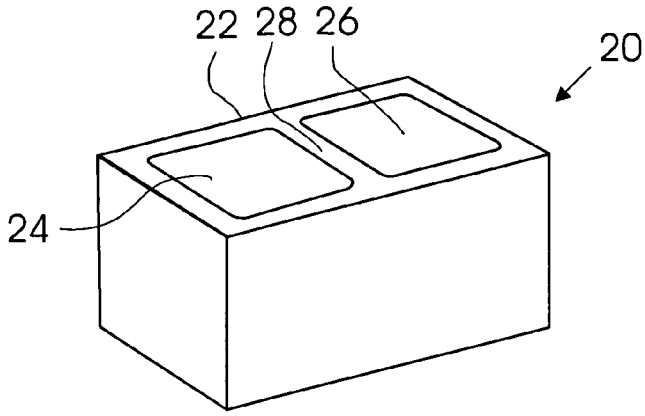
Fig. 1 PRIOR ART
FIG. 1 is a three-dimensional view of a typical known hollow modular concrete block.
Figure 2:
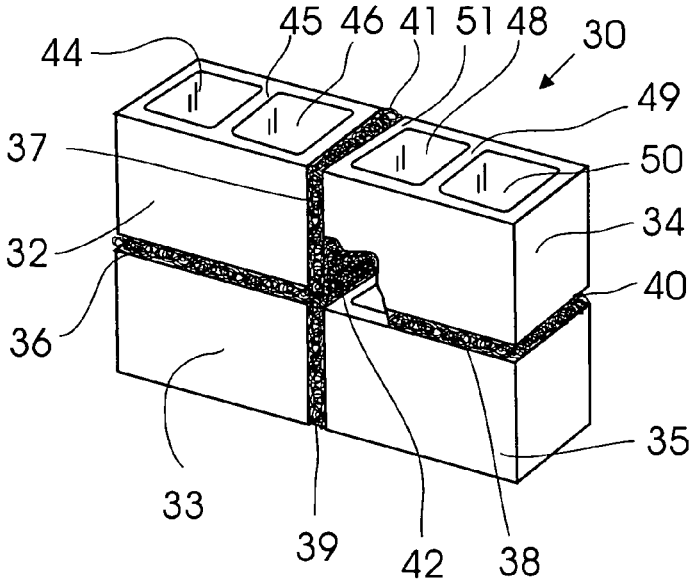
Fig. 2 PRIOR ART
FIG. 2 is a three-dimensional view of a part of a wall assembled from the hollow modular building blocks shown in FIG. 1.
Figure 3:
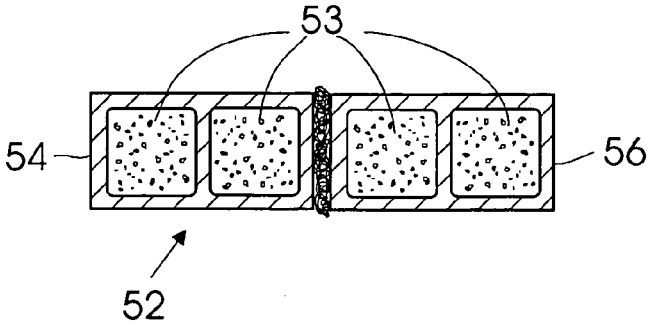
Fig. 3 PRIOR ART
FIG. 3 is a top view of the structure of FIG. 2.
Figure 4:
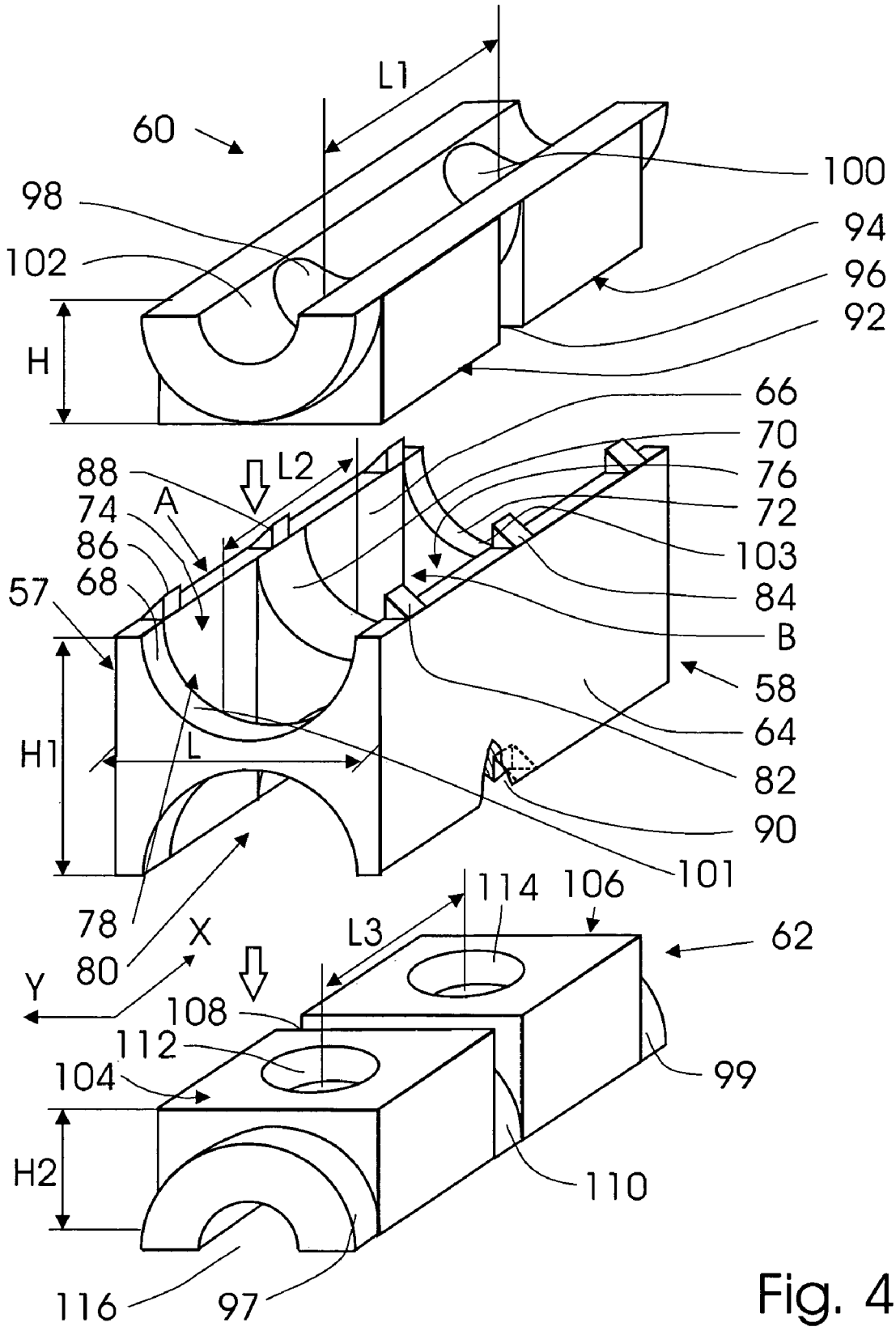
FIG. 4 is an exploded three-dimensional view of a basic modular hollow block of the present invention.

An example of a basic hollow modular building block 57 made in accordance with one embodiment of the invention is shown in FIG. 4, which is an exploded three-dimensional view of a block consisting of three elements, i.e., a block body 58, an upper insert 60, and a lower insert 62.

The block body 58 can be made, e.g., in the form of a parallelepiped, from various materials such as wood, plastic, metal, gypsum, ceramic, stone, or preformed from light cement, concrete, fiber-reinforced concrete. It can be made as an integral body or assembled from several components.

These components are the following: an outer or external wall 64 which, after assembling of the blocks into a construction element such as a wall of the building, may comprise a finally textured external surface of the building wall; an inner or internal wall 66, which, after assembling of the blocks into a construction element such as a wall of the building, may comprise a finally decorated surface of the interior design of the room; three parallel connection elements 68, 70, and 72 which interconnects the external wall 64 with the internal wall 66. The connection elements 68 and 72 constitute side walls of the block body 58, and through openings 74 and 76 are formed between the side walls 68, 72 and the connection element 70. Furthermore, through recesses 78 and 80 are formed on the upper and lower sides of the block body 58, respectively. These recesses extend in the longitudinal direction of the block body shown by the arrow X in FIG. 4. In the embodiment of FIG. 4, the through recesses 78 and 80 have a semicircular cross sections in the transverse direction of the block body 58 shown by the arrow Y.

Reference numerals 82, 84, 86, 88 designate self-aligning self-fixing projections on the upper surface of the block body 58 for fixing the adjacent blocks with respect to each other when the blocks are assembled by stacking one onto the other. It is understood that recesses (only one of which 90 is shown in a partially broken external wall 64 in FIG. 4) for insertion of the projections 82, 84, 86, 88 are provided on the lower surface of the block body 58. It is understood that in order to prevent penetration of moisture into the interior of the cell, the projections 82, 84, 86, 88 are inclined from the inner to outer side of the respective wall 64 or 66.

The upper insert 60 is made of a deformable material with non-resilient properties which allow non-elastic deformations which may occur during setting of the cement inside the insert. An examples of such materials are foam plastics, such as foam polyethylene, extruded polystyrene, or a compressed chip wood board, glass wool, etc. This element fulfills three functions, i.e., a function of heat/cold insulation, a function of a formwork for molding a cementation material, and a function of releasing a lateral load applied to the internal and external walls 66 and 64, respectively, which will be described below. The upper insert 60 is molded or preformed as an integral body, which has two projections 92 and 94 with a recess 96 between them, which extends in the direction of the arrow Y. Projections 92 and 94 have cross sections that ensure free insertion of the projections 92 and 94 into the through openings 74 and 76 during assembling of the modular block. The height H of the upper insert 60 is equal to a half of the height H1 of the block body 58 between the upper and lower surfaces of the block. The recess 94 is saddled onto the connection element 70. The upper insert 60 has a pair of through vertical openings 98 and 100 with the center distance L1 between the centers of these openings equal to the center distance L2 between the centers of the through openings 74 and 76 in the block body 58. A through longitudinal recess 102 extending in the direction of arrow X is formed on the side of the upper insert 60 opposite to the recess 96. Reference numerals 97 and 99 designate outer semi-cylindrical projections which rest onto inner semi-cylindrical surfaces 101 and 103 of the block 57.

The lower insert 62 is made of the same material as the upper one. This element fulfills the same aforementioned three functions as the upper insert 60. The lower insert 62 also is molded or preformed as an integral body, which has two projections 104 and 106 with a recess 108 between them, which is oriented in the direction of the arrow Y. Projections 104 and 106 have cross sections that ensure free insertion of the projections 104 and 106 into the through openings 74 and 76 of the block body 58 during assembling of the modular block. The height H2 of the lower insert 62 is equal to a half of the height H1 of the block body 58 between the upper and lower surfaces of the block. The recess 108 has a cross section that allows saddling of the lower side of the connection element 70 onto the profiled bottom surface 110 of the recess 108. The lower insert 62 has a pair of through vertical openings 112 and 114 with the center distance L3 between the centers of these openings approximately equal to the aforementioned center distances L1 and L2. A through longitudinal recess 116 extending in the direction of arrow X is formed on the side of the lower insert 62 opposite to the recess 108.

Thus, it can be concluded that the basic modular block 57 shown in FIG. 4 consists at least of two cells A and B. Each cell is defined by a separate through opening into which a projection of the insert is inserted. In the embodiment of FIG. 4 such openings are openings 74 and 76. The cells are connected by a connection element, in this case by the connection element 70. Each cell has a certain direction or orientation defined by the direction of a recess, such as the recess 78 in the longitudinal direction of the block. It is important to note that the distances between the cells in all configurations of the blocks of the present invention are equal. In the embodiment of FIG. 4 this is distance L1. The cells are thermally isolated by the material of the insert, and the "bridges of cold" are significantly reduced in their cross sections and remain only through the connection element 70 and side walls 68 and 72 of the block. In the embodiment of FIG. 4 both cells have the same orientation and are arranged in a straight-line manner.

Figure 5:
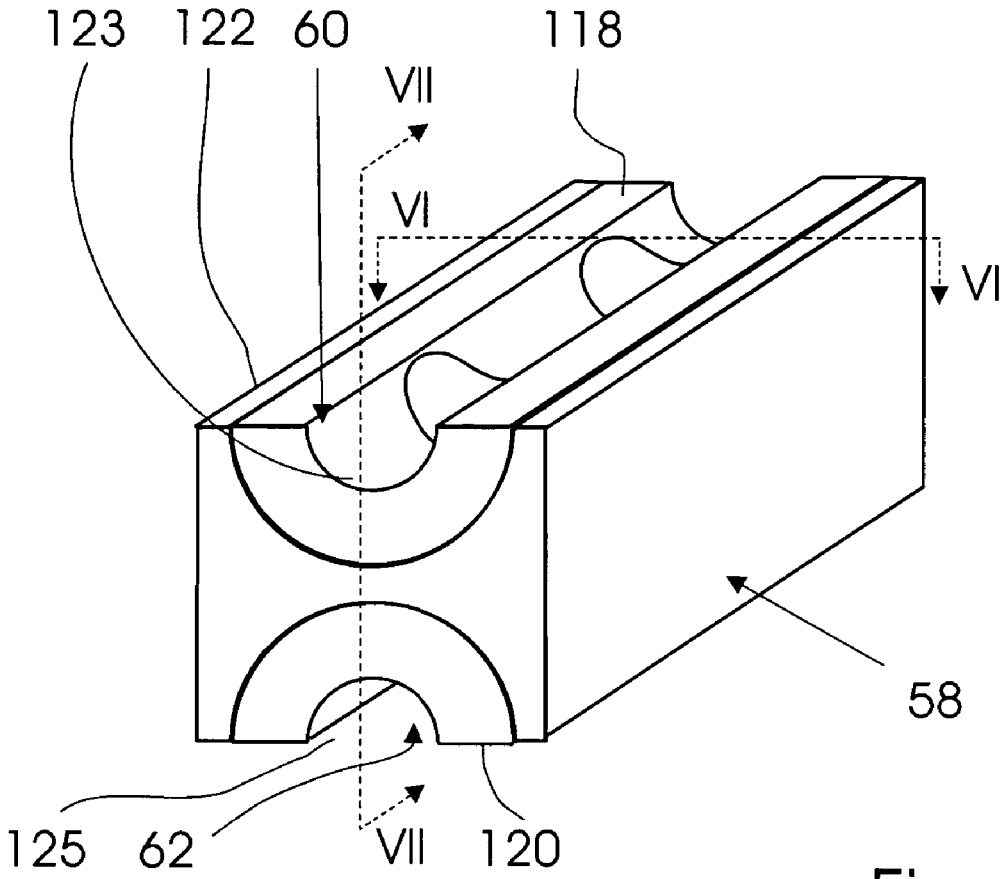
FIG. 5 is a three-dimensional view that illustrates appearance of a modular block of the invention in an assembled state.
Figure 6:
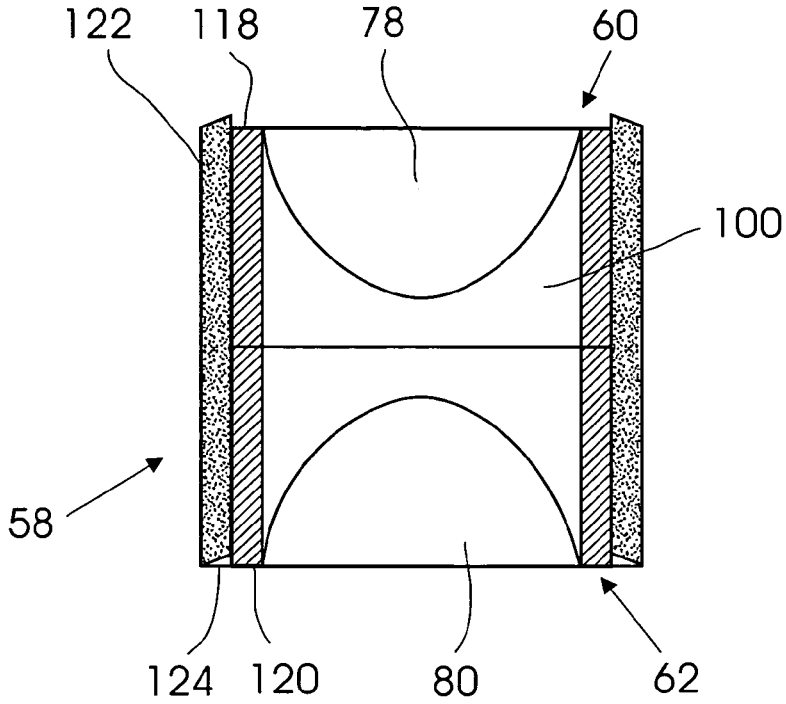
FIGS. 6 and 7 are transverse and longitudinal sectional views along lines VI—VI and VII—VII of FIG. 4, respectively, these views illustrating internal positions of inserts in the block body.
Figure 7:
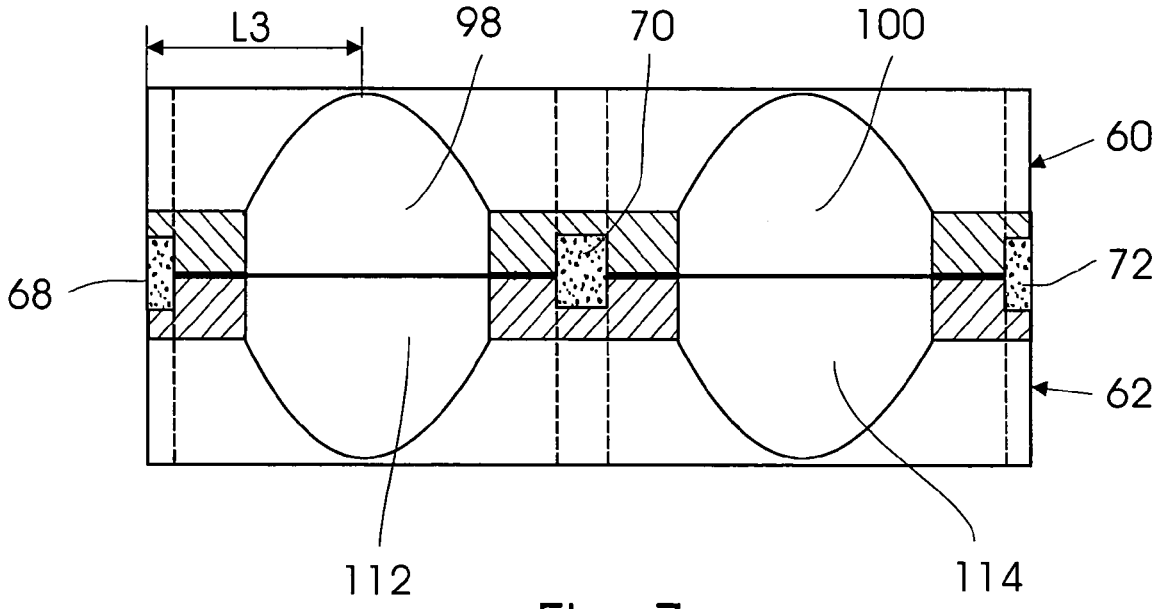

FIG. 5 is a three-dimensional view that illustrates appearance of a modular block of the invention in an assembled state, and FIGS. 6 and 7, which illustrate internal positions of inserts 60 and 62 in the block body 58, are transverse and longitudinal sectional views along lines VI—VI and VII—VII of FIG. 5, respectively. It can be seen from FIGS. 5 and 6 that in an assembled state of the modular block the edges 118 and 120 of the upper and lower inserts 60 and 62 are in flush with outer surfaces 122 and 124 of the block body 58. It is also seen that in the embodiment of FIGS. 4–7 the through recesses 123 and 125 have a semicircular cross section. As shown in FIG. 6, openings 100 and 114 of the upper and lower inserts form a single through opening passing through the entire block in a vertical direction. The same is true for openings 98 and 112. The lower surface of the upper insert 60 is in contact with the upper surface of the lower insert 62. Reference numeral 68, 70, and 72 in FIG. 7 shows positions of the connection elements in the longitudinal cross section of the assembled block.

It is important that the thickness of the connection element 70 be twice the thickness of side walls 68 and 72. It is important for manipulation with the inserts and for versatility of the assembling in making a masonry-like staggered arrangements of the blocks.

Figure 8:
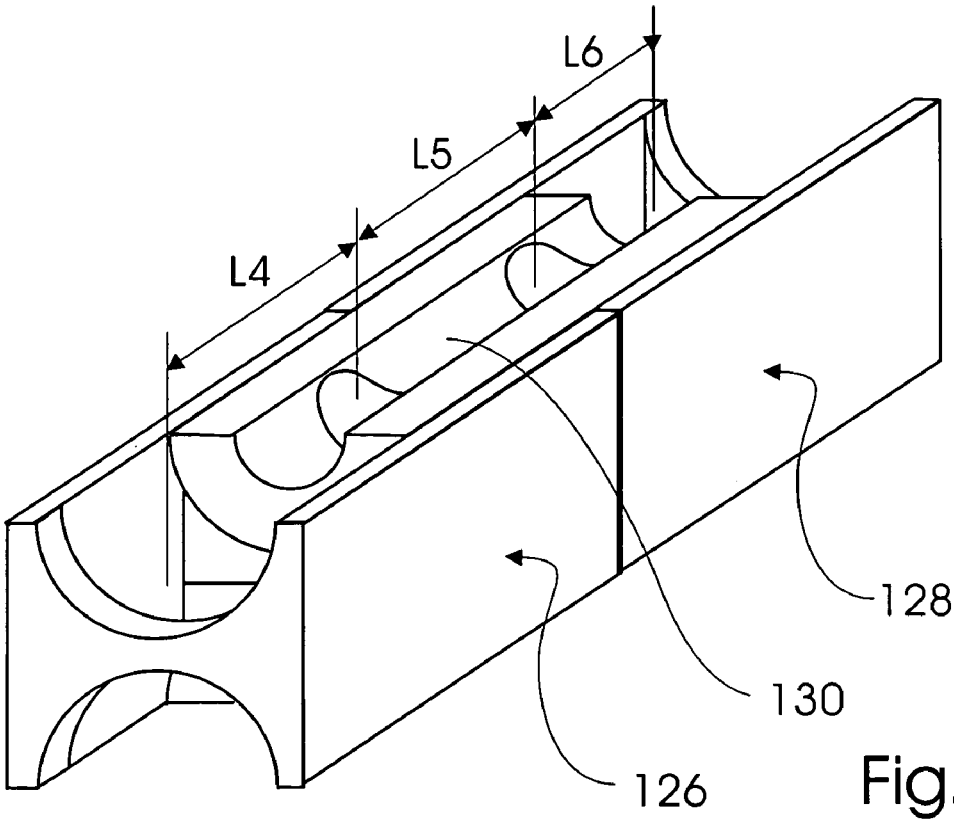
FIG. 8 is a three-dimensional view of an assembly consisting of two modular blocks of the invention.
Figure 9:
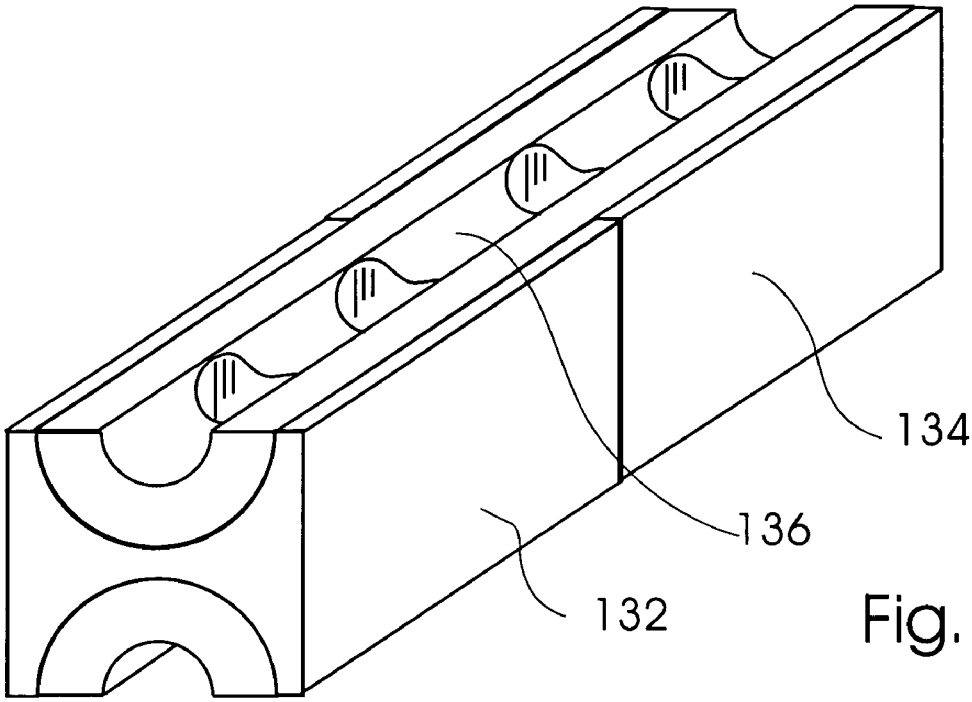
FIG. 9 is a three-dimensional view modular blocks are interconnected by a common insert.

FIG. 8 is a three-dimensional view of an assembly consisting of two modular blocks 126 and 128. Each block has a two-cell structure shown in FIG. 4. It can be seen that the blocks 126 and 128 are interconnected by means of common inserts (only an upper insert 130 is seen in this drawing). In this case, the projection portions, such as portions 94 and 106 of the upper and lower inserts 60 and 62 are inserted into two adjacent recesses, such as recesses 74 and 76 of the blocks 126 and 128 (FIG. 4). In other words, the upper insert 130 (as well as the lower insert) is fixed in the neighboring recesses of the adjacent blocks, i.e., bridges the blocks and secures them to each other. This is possible when the distances L4, L5, and L6 (FIG. 8) between the centers of the adjacent vertical openings are equal to distances L1, L2, L3 (FIG. 4). In an assembly of FIG. 9 modular blocks 132 and 134 are interconnected by common inserts (only an upper insert 136 is seen in this drawing) having a length equal to the length of two modular blocks. In this case the insert 130 has a two-cell structure with four projections inserted into all four openings of both blocks. The embodiment of FIG. 9 with the use of a single insert for interconnecting two block is shown only as an example. It is understood that a common insert may span three or more than three blocks at the same time.

Figure 10:
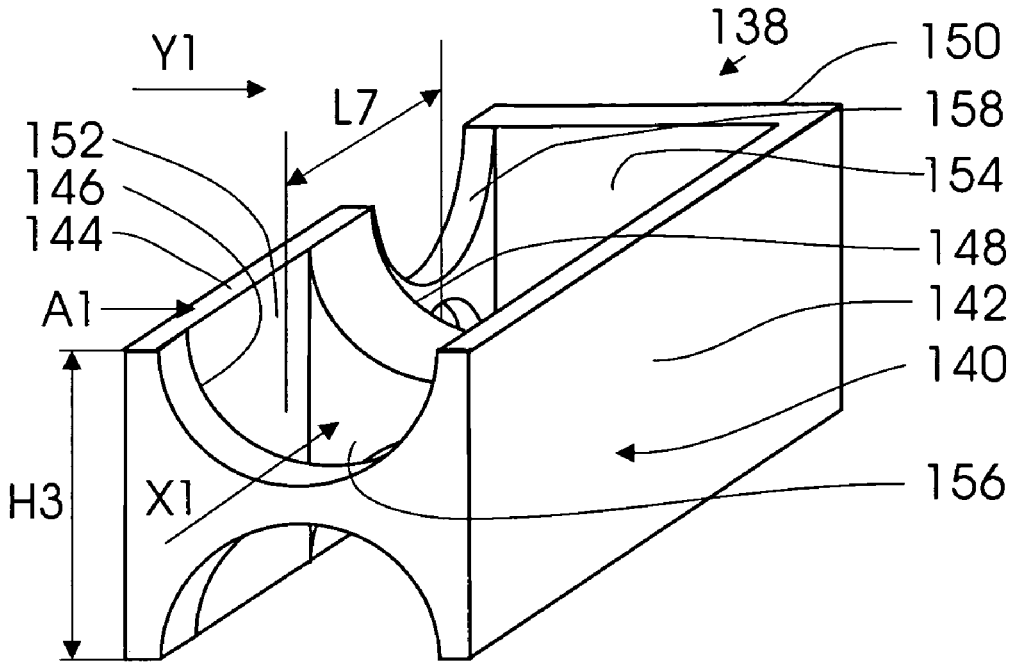
FIG. 10 is a three-dimensional view of an angular hollow modular building block of the invention for construction of corners of the buildings or other structures.

FIG. 10 illustrates an angular hollow modular building block 138 of the invention for construction of angular parts of the buildings or other structures. This block also has a two-cell structure. The block body 140 consists of an outer or external wall 142, which after assembling of the blocks into a construction element such as a wall of the building, may comprise a finally textured external surface of the building wall, an inner or internal wall 144, which, after assembling of the blocks into a construction element such as a wall of the building, may comprise a finally decorated surface of the interior design of the room, and three parallel connection elements 146, 148, and 150 which interconnects the external wall 142 with the internal wall 144. It can be seen from FIG. 10 that the connection element 150 constitutes an external or outer wall of the building or another structural element. Through openings 152 and 154 are formed between the connection elements 146, 148, and 150. Furthermore, similar to the construction of the building blocks of the previous embodiments, recesses 156 and 158 are formed on the upper and lower sides of the block body 140. Only upper recesses 156 and 158 are designated in FIG. 10. Arrow X1 shows direction of cell defined by the recess 156, and arrow Y1 shows direction of the cell defined by the recess 158. It can be seen that the directions of both recesses are perpendicular to each other. It can be seen that the recess 156 intersects the recess 158. In the embodiment of FIG. 10 the recesses 156 and 158 have a semicircular cross sections. The unit modular block 138 of the embodiment shown in FIG. 10 also has a two-cell structure with the cells A1 and B1 defined by openings 152 and 154. However, the cells A1 and B1 have mutually perpendicular directions of the recesses 156 and 158. It can be seen that in an angular modular block 138 of FIG. 10 the recesses 156 and 158 are not through and are terminated by the walls 150 and 140, respectively.

Figure 11:
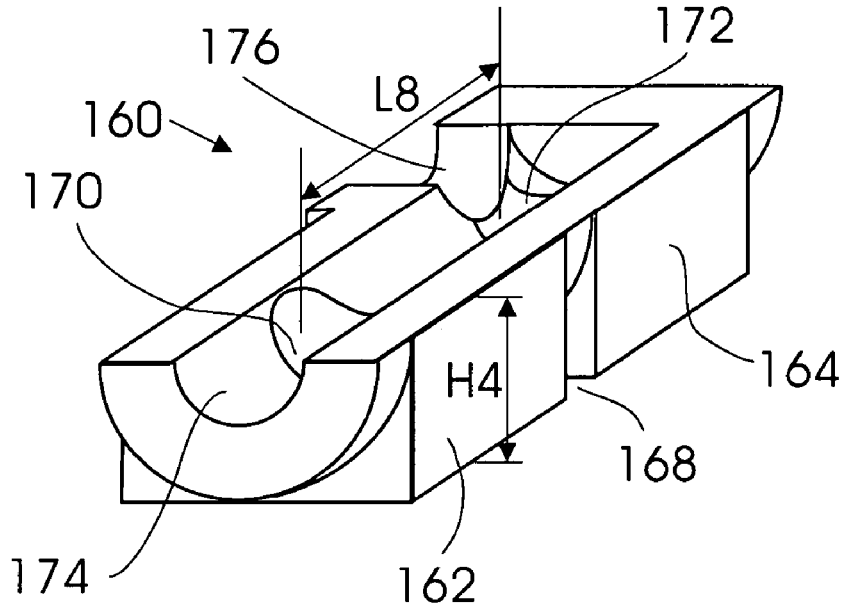
FIG. 11 is a three-dimensional view of upper insert for the building block of FIG. 10.

FIG. 11 is a three-dimensional view of upper insert 160 for the building block 138 of FIG. 10. This insert can be made of the same thermal insulation materials as the inserts of the previous embodiments. Similar to inserts of other embodiments, the insert 160 fulfills three aforementioned functions, i.e., a function of heat/cold insulation, a function of a formwork, and a load-release function. This element is molded or preformed as an integral body, which has two projections 162 and 164 with a recess 168 between them, which extend in the direction of the arrow Y1 shown in FIG. 10. Projections 162 and 164 have cross sections that ensure free insertion of the projections 162 and 164 into the through openings 152 and 154 during assembling of the modular block. The height H4 of the upper insert 160 is equal to a half of the height H3 of the block body 140 between the upper and lower surfaces of the block. The recess 168 is saddled onto the connection element 148 (FIG. 10). The upper insert 160 has a pair of through vertical openings 170 and 172 with the center distance L8 between the centers of these openings approximately equal to the center distance L7 between the centers of through openings 152 and 154 in the block body 140 (FIG. 10). Recesses 174 and 176, which have the same orientation and shape as recesses 156 and 158 (FIG. 10) are formed in the upper insert 160.

The lower insert for block 138 is not shown, but it is an exact mirror image of the upper insert 160 relative to an imaginary plane that may contain arrows X1 and Y1 shown in FIG. 10 and is located under the upper insert.

Figure 12:
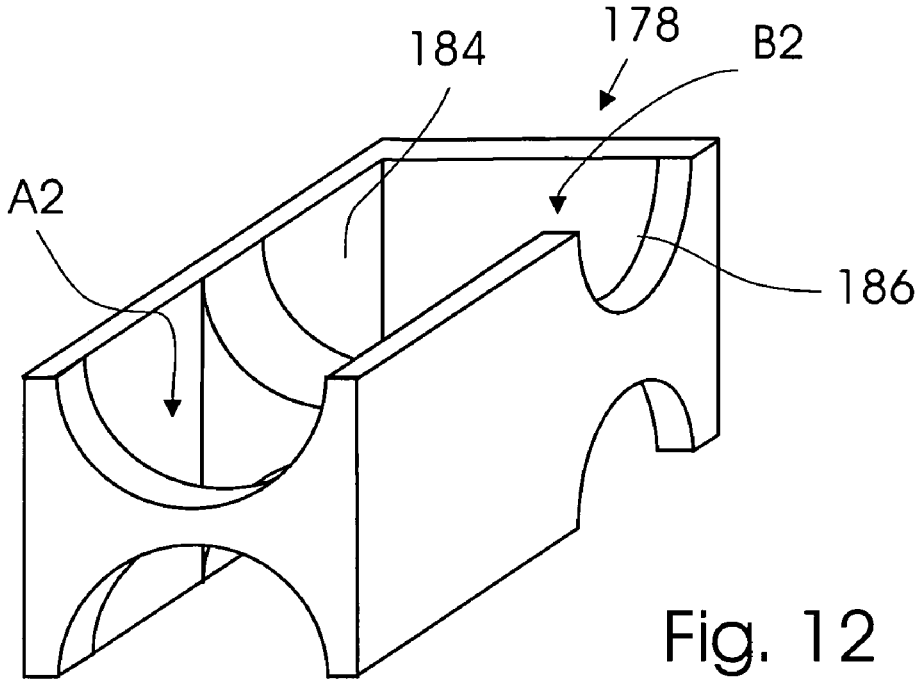
FIG. 12 show the angular block for construction of the wall, which starts from this block and extends in the direction opposite to the arrow Y1 shown in FIG. 10.
Figure 13:
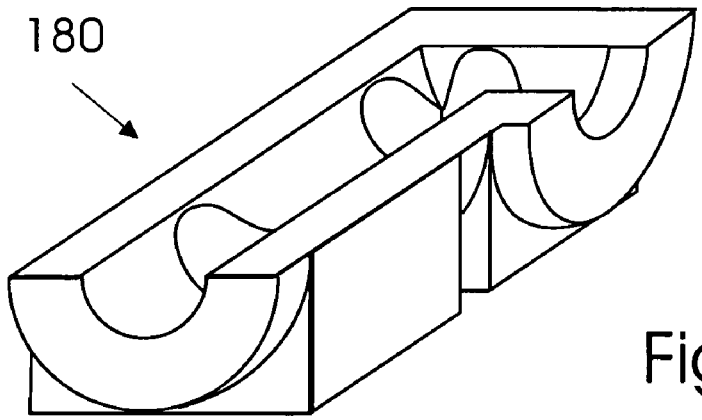
FIG. 13 and FIG. 14 show upper and lower inserts for the block of FIG. 12.
Figure 14:
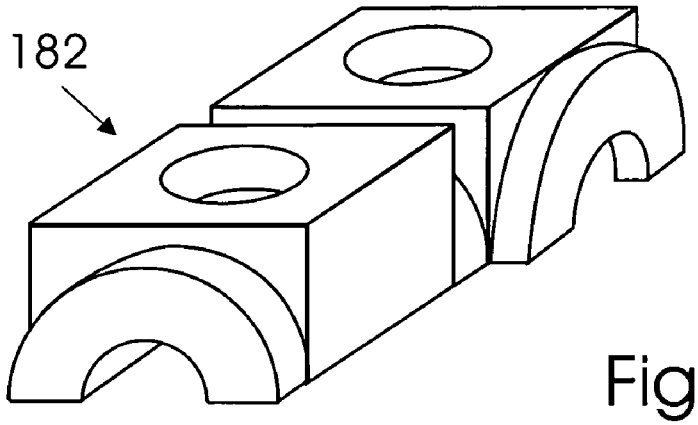

FIGS. 10 and 11 show the angular block 138 and the angular insert 160 for construction of the wall, which starts from this block and extends in the direction opposite to the arrow Y1. FIGS. 12, 13, and FIG. 14 show an angular block 178, an upper insert 180, and a lower insert 182 for construction of the wall which starts from this block and extends in the direction of the arrow Y1 (FIG. 10). Detailed description of the block 178 and of the inserts 180 and 182 is omitted since they are almost identical to those described and shown with reference to the embodiment of FIGS. 10 and 11 and differ from them by the fact that the external wall 184 which closes the recess 186 is located on the side opposite to the recess-closing wall 142 shown in FIG. 10. In other words, the angular module of FIG. 10 can be defined as a right angular block, and the block of FIG. 12 can be defined as a left angular block. As shown in FIG. 12, the block 178 consists of cells A2 and B2 having mutually perpendicular orientation.

Figure 15:
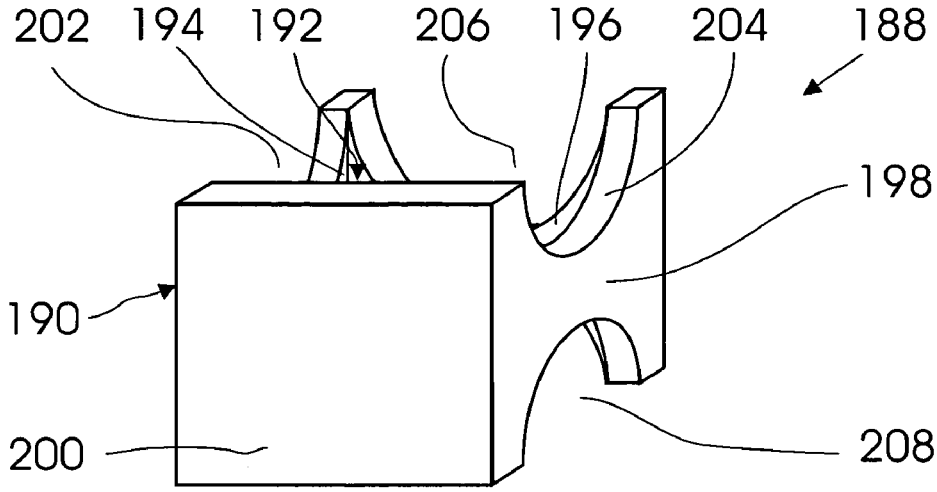
FIG. 15 is a three-dimensional view of a single-cell transition modular block for initiation of inner load-carrying walls or other structures.
Figure 16:
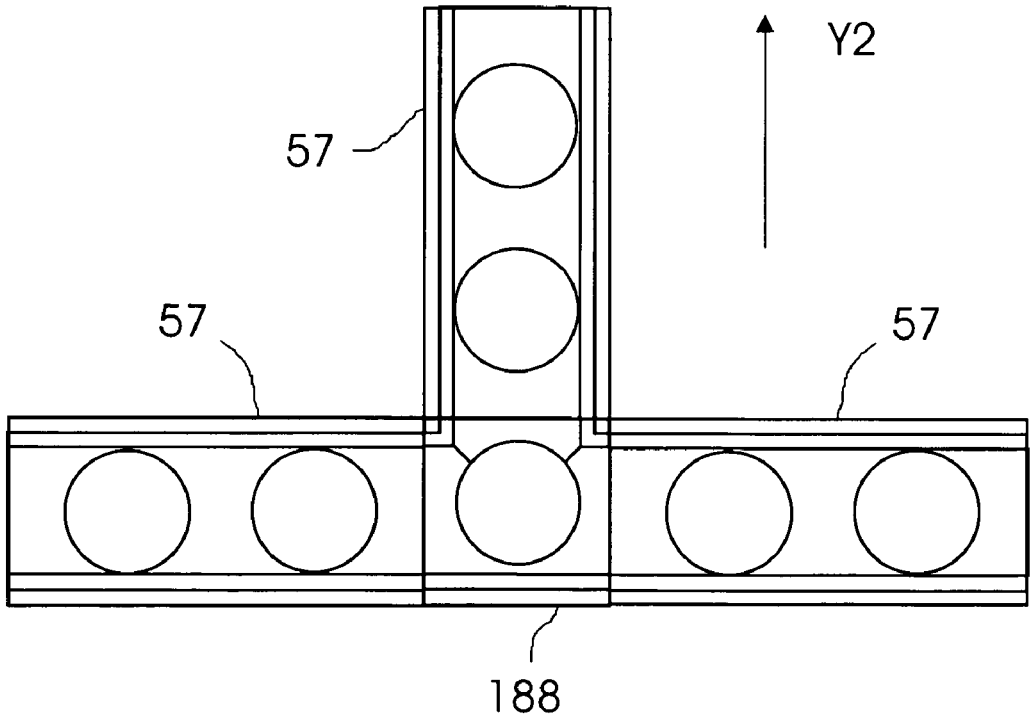
FIG. 16 is a plan view that illustrates arrangement of basic two-cell blocks of FIG. 4 in connection with the single-cell transition block of FIG. 15 for initiation of the inner wall.

FIG. 15 is a three-dimensional view of a single-cell hollow transition modular block 188 designed, as shown in FIG. 16, for initiation of internal load-carrying walls. As can be seen from FIG. 16, the transition block 188 interconnects basic blocks 57 of FIG. 4 for the construction of the wall in the direction of arrow Y2. The block 188 has a box-like body 190 with a through opening 192 confined by four side walls 194, 196, 198, and 200. Opposite walls 194, 198 and one side wall 196 have respective semi-cylindrical recesses 202, 204, and 206 in the upper part of the body 190. Symmetrically arranged recesses are formed in the lower part of the body 190, only one of which 208 is seen in FIG. 15.

Figure 17:
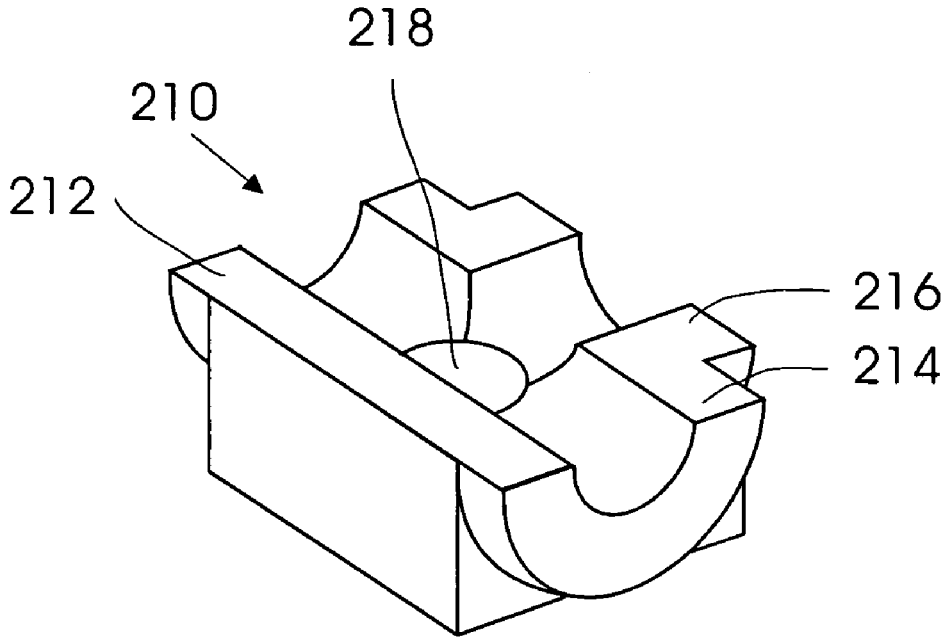
FIG. 17 is a three-dimensional view of an insert for the single-cell block of FIG. 15.

FIG. 17 is a three dimensional view of a single-cell insert 210 for the transition modular block 188 of FIG. 15. The insert 210 has external dimensions that allow free insertion of the insert 210 into the opening 192. The block 188 utilizes upper and lower inserts of identical configuration. The insert 210 has semi-cylindrical projections 212, 214, and 216 which in inserted position of the insert 210 rest on the inner cylindrical surfaces 202, 198, and 206 of the block 188. The insert 210 has a single through opening 218.

Figure 18:
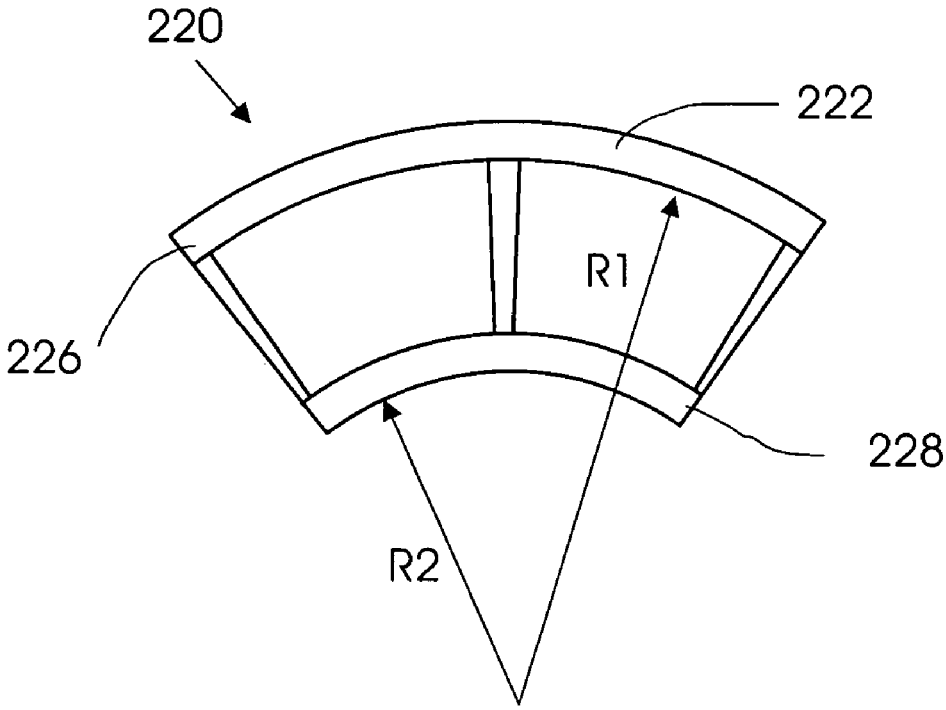
FIG. 18 is a plan view of a basic rounded modular block for construction of rounded walls of other structures.

FIG. 18 is a plan view of a basic rounded modular block 220 for the construction of rounded walls or other structures. In general this modular block is the same as the basic block 57 shown in FIG. 4 and differs from it by the fact that the outer wall 222 and the inner wall 224 are rounded over the outer radius R1 and the inner radius R2, respectively and that the side walls 226 and 228 are directed along the radial lines. The same is true for the inserts (not shown) which otherwise are similar to the inserts 60 and 62 of FIG. 4.

Figure 19:
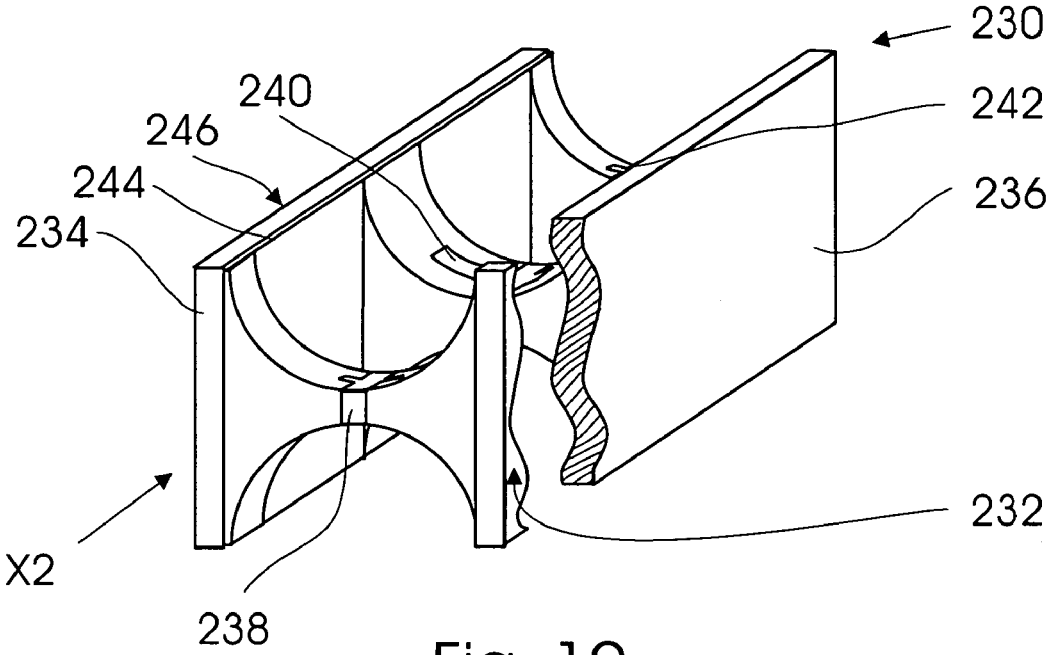
FIG. 19 is a three-dimensional view of a modular block with auxiliary inserts that completely eliminate any bridges of cold in the structure of the block.

FIG. 19 is a three-dimensional view of a modular hollow building block 230 of the invention with significantly improved heat/cold-insulating properties. The modular block 230 of FIG. 18 is similar to the block 57 shown in FIG. 4 and differs from it by the fact that the block body 232 is divided in the longitudinal direction of the body 232 shown by the arrow X2 into two parts 234 and 236 which are interconnected via auxiliary inserts 238, 240, and 242 made of a material with extremely high heat/cold insulating properties, such as phenol formaldehyde plastic, high-density polyethylene, polyvinylchloride, etc.

For further amplification of heat/cold-insulation properties, the block 230 can be provided with a thin metal shield 244 molded into the material of the external wall 246 or applied onto its internal surface, e.g., by metallization. The shield 244 will prevent loss of heat via radiation and will return a significant amount of heat back into the interior part of the building or other structure.

Figure 20:
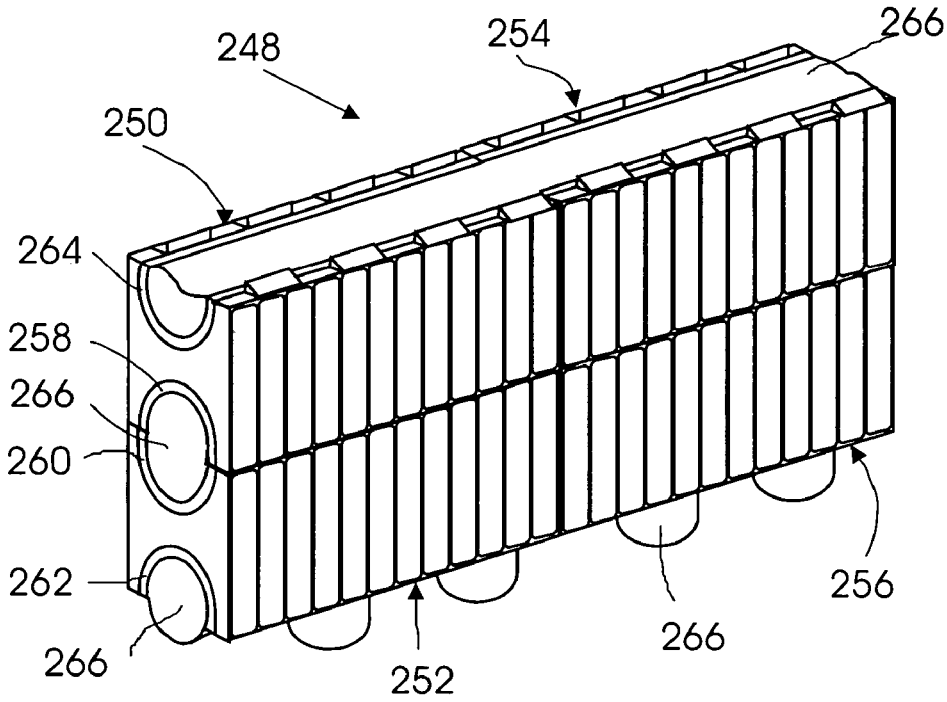
FIG. 20 is a three-dimensional view of a part of a wall built from the modular hollow blocks of the present invention illustrating the method of the invention.

FIG. 20 is a three-dimensional view of a part of a wall 248 built from the modular hollow blocks 250, 252, 254, and 256 of the present invention illustrating the method of the invention. In this drawing, reference numerals 258, 260, 252, and 264 designate inserts which constitute a formwork for molding the cementation material that forms a multiple-cell structure (in the case of one row) or a lattice-like load-carrying structure 266 of the wall (in the case of multiple rows of blocks).

Figure 21:
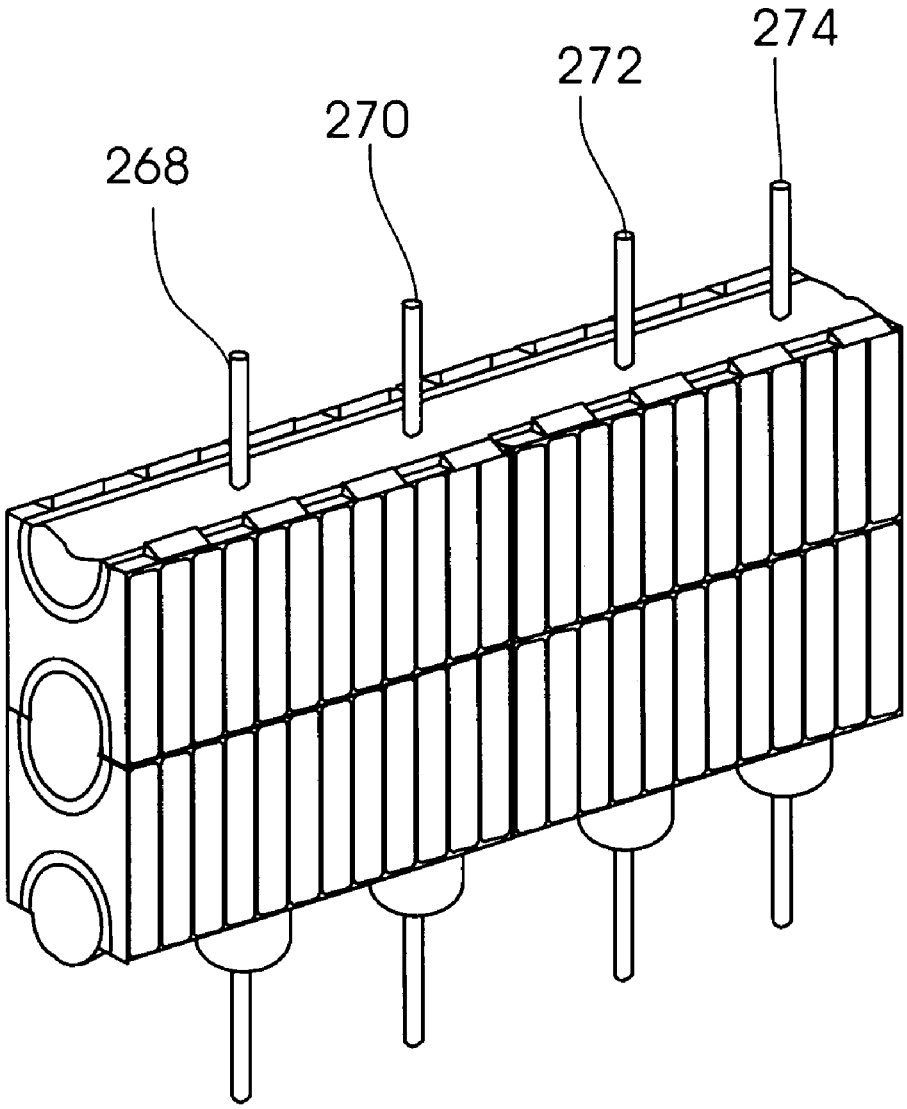
FIG. 21 is a three-dimensional view of a part of a wall built from the modular hollow blocks of the present invention with block-holding reinforcement bars.

The wall 248 is produced by inserting the inserts, such as inserts 60 and 62 (FIG. 4) into recesses, such as recesses 78 and 80 of the block 57 (FIG. 4), assembling the blocks into the structure of the wall 248. If the blocks are provided with lock recesses such as the recess 90 of FIG. 4, these recesses are fitted onto the projections 82, 84, 86, 88 of the type shown in FIG. 4. It is understood that the connection via recesses 90 and the projections 82–88 are shown only as examples. For example, as shown in FIG. 21, which is a view similar to FIG. 20, the blocks can be held in place by means of block-holding reinforcement bars 268, 270, 272, 274.

Figure 22:
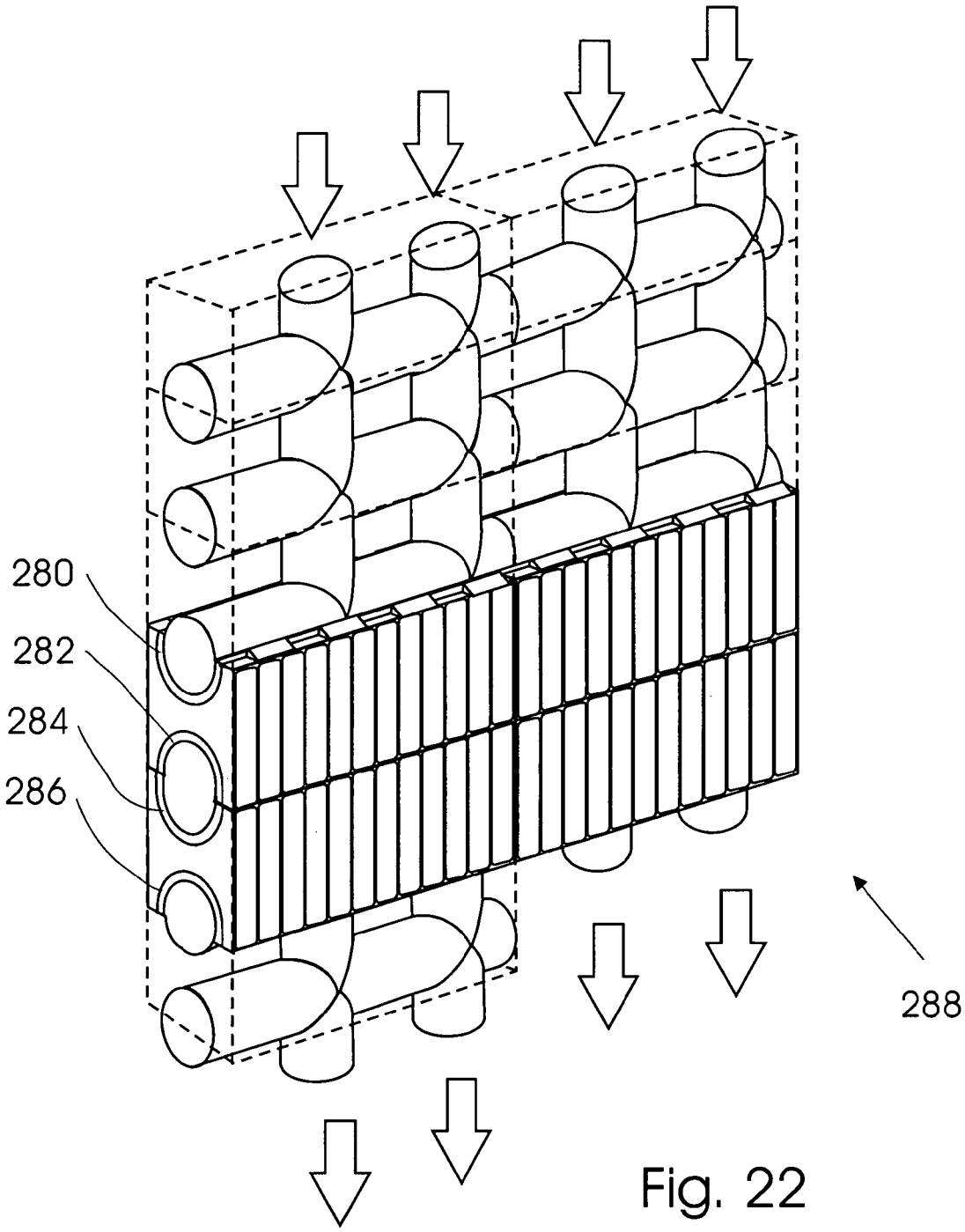
FIG. 22 is a three-dimensional view illustrating a lattice-like load-carrying structure formed by the method of the invention.

After the wall or a part of the wall 248 is assembled, the verticals holes 98,112, 100, 114, and axial recesses 102, 116 of all interconnected blocks form a continuous lattice-like space. This space is filled with a cementation material in a liquid state. If the blocks are held by reinforcement bars 268–274, prior to pouring the cementation material these bars are inserted into the centers of the vertical holes formed in the inserts. After the cementation material is solidified or set, it form a continuous lattice-like framework 276 of the type shown in FIG. 22. It can be seen from FIG. 22, that the outer wall 278 of each block forms an exterior surface of the wall built from the blocks. In this construction, the inserts 280, 282, 284, 286 are used as a formwork for the formation of the lattice-like load-carrying skeleton of the structural element, in this embodiment, a part of the wall 288.

Alternatively, the wall 248 can be assembled row-by-row. In this case, first the lowermost row of the blocks 252, 256 is assembled and the space inside the inserts is filled with the cement. The second row is built on the first row from the blocks 250, 254, and the cement is poured into the inner space of the inserts while the cement of the first row is not yet solidified for bonding to the cement row. Then the third row is assembled, etc.

Since the insert is made of a material such as porous plastic which allows non-elastic deformations, the lateral forces applied to the inner and outer walls of the blocks are dampened by the material of the inserts, whereby the inner and outer walls are free of deformations.

It is known that as compared to the continuous plate-like wall, the lattice-type structure of the same mass, has higher stress and load-carrying capacity. This is because, in case of overload, the lattice will break only in a locally overload area, while the lattice as a whole will remain undamaged. This is especially important in the case of a building in a seismic area. The anti-seismic properties can be further improved by forming the load-carrying framework from fiber-reinforced cement, or by interconnecting the vertical reinforcement bars 268–274 with horizontal bars (not shown).

Thus, it has been shown that the present invention provides a hollow modular building block which works under no-load or low-load conditions and therefore can be made of wood, plastics, and lightweight concrete, such as a fiber-reinforced concrete, and different composite materials. The hollow modular building block of the invention is free of bridges of cold and possesses excellent heat/cold insulating properties. The block combines functions of a formwork for the formation of a load-carrying framework of the structural element with additional functions of outer and inner surfaces of the construction element such as texture, color, decorative features, etc. Although the invention has been shown and described with reference to specific embodiments, it is understood that these embodiments should not be construed as limiting the areas of application of the invention and that any changes and modifications are possible, provided these changes and modifications do not depart from the scope of the attached patent claims. For example, the inner and outer walls of the blocks may have a relief configuration. Thus the outer walls can be formed as wooden logs, and then inner walls can be made as a masonry, or vice verse. The inner walls can be selected in accordance with any interior decoration design. The recesses may have a rectangular cross section rather than a semi-circular cross section. A metallized plastic can be used as a thermoinsulation shield. The inserts can be made in a chain-like form for insertion into a series of sequentially arranged blocks which can be interconnected by such multiple inserts. The chain-like insert can be cut in a place required by the design of the building or structure assembled from the building blocks. The holes in the inserts may have cross sections other than round. The block may not be molded but assembled from separate parts. The connection elements between the walls of the block can be shifted to the sides for a half-length of the cell, so that in an assembled state the half-cells will form a full-size cell in combination with the half-cell of the adjacent block. The blocks stacked onto each other in a vertical direction can be fixed with connections other than projections 82, 84, 86, 88 on the lower block and recesses such as 90 on the upper block. The blocks of the invention can be used for forming structural elements other than walls, e.g., for foundations, roofs, partitions, beams, etc.

What is claimed is:

1. A universal hollow modular building block for construction of buildings and structural elements comprising:

a block body formed from an outer wall, an inner wall, and at least a first connection element and a second connection element which interconnect said outer wall and said inner wall and form a first through opening in a vertical direction, said block body having longitudinal direction, said block body having an upper side and lower side;

a first upper recess extending in said longitudinal direction and formed on said upper side of said block body in at least in one of said connection elements;

a first lower recess extending in said longitudinal direction and formed on the lower side of said block body in at least in one of said connection elements;

an upper insert made of a heat-insulating material, inserted into said first through opening from the upper side of said block body, and supported by said upper recess;

a lower insert made of a heat-insulating material, inserted into said first through opening from the lower side of said block body, and at least partially supporting said block body via contact with said lower recess;

a second through opening formed in a vertical direction in said upper insert;

a third through opening formed in a vertical direction in said lower insert, so that when said upper insert and said lower insert are inserted into said first through opening and a plurality of said universal hollow modular building blocks are assembled into a structural element such as a wall, said upper recess, said lower recess, said second through opening, and said third through opening of each of said blocks form a continuous lattice-like space suitable for pouring a moldable and curable material which after curing forms a lattice-like load-carrying framework;

said block body being divided along said longitudinal direction and in the middle of said connection elements by auxiliary inserts made of a material with high heat-insulating properties.

2. The building block of claim 1, wherein said material of high-insulating properties is selected from the group consisting of phenol formaldehyde plastic, high-density polyethylene, and polyvinylchloride.

3. The building block of claim 1, wherein said first upper recess and said second upper recess are open from the side of said first connection element and are closed from the side of said second connection element, whereas said second upper recess and said second lower recess are open from the side of said outer wall and are closed from the side of said inner wall.

4. The building block of claim 1, wherein said first upper recess and said second upper recess are open from the side of said first connection element and are closed from the side of said second connection element, whereas said second upper recess and said second lower recess are open from the side of said inner wall and are closed from the side of said outer wall.

5. The building block of claim 1, wherein said upper insert is open from the side of said first connection element of said building block and is closed from the side of said second connection element of said building block, whereas said lower insert is a mirror image of said upper insert.

6. The building block of claim 1, wherein said upper insert is open from the side of said first connection element of said building block and is closed from the side of said second connection element of said building block, whereas said lower insert is a mirror image of said upper insert.

7. A universal hollow modular building block for construction of buildings and structural elements comprising:

a block body formed from an outer wall, an inner wall, and at least a first connection element and a second connection element which interconnect said outer wall and said inner wall and form a first through opening in a vertical direction, said block body having longitudinal direction, said block body having an upper side and lower side;

a first upper recess extending in said longitudinal direction and formed on said upper side of said block body in at least in one of said connection elements;

a first lower recess extending in said longitudinal direction and formed on the lower side of said block body in at least in one of said connection elements;

an upper insert made of a heat-insulating material, inserted into said first through opening from the upper side of said block body, and supported by said upper recess;

a lower insert made of a heat-insulating material, inserted into said first through opening from the lower side of said block body, and at least partially supporting said block body via contact with said lower recess;

a second through opening formed in a vertical direction in said upper insert;

a third through opening formed in a vertical direction in said lower insert, so that when said upper insert and said lower insert are inserted into said first through opening and a plurality of said universal hollow modular building blocks are assembled into a structural element such as a wall, said upper recess, said lower recess, said second through opening, and said third through opening of each of said blocks form a continuous lattice-like space suitable for pouring a moldable and curable material which after curing forms a lattice-like load-carrying framework;

said upper recess and said lower recess being through recesses which pass from said first connection element to said second connection element.

8. A universal hollow modular building block for construction of buildings and structural elements comprising:

a block body formed from an outer wall, an inner wall, and at least a first connection element and a second connection element which interconnect said outer wall and said inner wall and form a first through opening in a vertical direction, said block body having longitudinal direction, said block body having an upper side and lower side;

a first upper recess extending in said longitudinal direction and formed on said upper side of said block body in at least in one of said connection elements;

a first lower recess extending in said longitudinal direction and formed on the lower side of said block body in at least in one of said connection elements;

an upper insert made of a heat-insulating material, inserted into said first through opening from the upper side of said block body, and supported by said upper recess;

a lower insert made of a heat-insulating material, inserted into said first through opening from the lower side of said block body, and at least partially supporting said block body via contact with said lower recess;

a second through opening formed in a vertical direction in said upper insert;

a third through opening formed in a vertical direction in said lower insert, so that when said upper insert and said lower insert are inserted into said first through opening and a plurality of said universal hollow modular building blocks are assembled into a structural element such as a wall, said upper recess, said lower recess, said second through opening, and said third through opening of each of said blocks form a continuous lattice-like space suitable for pouring a moldable and curable material which after curing forms a lattice-like load-carrying framework; and a second upper recess and a second lower recess oriented in a direction perpendicular to said longitudinal direction, open from the side of said inner wall, and closed from the side of said outer wall.

9. The building block of claim 1, wherein said outer wall and said inner wall are rounded over a radius, and wherein said first connection element and said second connection element are oriented along said radius.

10. The building block of claim 1, wherein said block body is made from a material selected from the group consisting of cement, fiber-reinforced cement, wood, stone, ceramic, metal, gypsum, and plastic and said heat-insulating material of said upper insert and of said lower insert is selected from the group consisting of foam plastic, polyethylene, extruded polystyrene, compressed wooden chip material, and glass wool.

11. A universal hollow modular building block for construction of buildings and structural elements comprising:

a block body formed from an outer wall, an inner wall, and at least a first connection element and a second connection element which interconnect said outer wall and said inner wall and form a first through opening in a vertical direction, said block body having longitudinal direction, said block body having an upper side and lower side;

a first upper recess extending in said longitudinal direction and formed on said upper side of said block body in at least in one of said connection elements;

a first lower recess extending in said longitudinal direction and formed on the lower side of said block body in at least in one of said connection elements;

an upper insert made of a heat-insulating material, inserted into said first through opening from the upper side of said block body, and supported by said upper recess;

a lower insert made of a heat-insulating material, inserted into said first through opening from the lower side of said block body, and at least partially supporting said block body via contact with said lower recess;

a second through opening formed in a vertical direction in said upper insert;

a third through opening formed in a vertical direction in said lower insert, so that when said upper insert and said lower insert are inserted into said first through opening and a plurality of said universal hollow modular building blocks are assembled into a structural element such as a wall, said upper recess, said lower recess, said second through opening, and said third through opening of each of said blocks form a continuous lattice-like space suitable for pouring a moldable and curable material which after curing forms a lattice-like load-carrying framework;

said block body being divided along said longitudinal direction and in the middle of said connection elements by auxiliary inserts made of a material with high heat-insulating properties; and a screen made of a metal sheet in contact with one of said outer wall and inner wall for radiating heat back in the direction from where this heat has arrived.

* * * * *